United States Patent [19]

Ofria et al.

[11] Patent Number: 4,957,070

[45] Date of Patent: Sep. 18, 1990

[54] ENGINE AIR-FUEL INTAKE TRIPLE MANIFOLD

[75] Inventors: Lawrence E. Ofria, Northridge; Francis R. Lyndhurst, Costa Mesa, both of Calif.

[73] Assignee: Thunder Power, Inc., Redondo Beach, Calif.

[21] Appl. No.: 445,290

[22] Filed: Dec. 5, 1989

[51] Int. Cl.[5] ..... F02M 35/10

[52] U.S. Cl. ..... 123/52 MB; 123/432

[58] Field of Search ..... 123/52 M, 52 MV, 52 MC, 123/52 MB, 432, 308

[56] References Cited

U.S. PATENT DOCUMENTS 3,809,032 5/1974 Morris .

4,246,874 1/1981 Nakagawa et al. ..... 123/308

FOREIGN PATENT DOCUMENTS 0108821 6/1984 Japan ..... 123/308

0208121 11/1984 Japan ..... 123/308

*Primary Examiner*—David A. Okonsky

*Attorney, Agent, or Firm*—William W. Haefliger

[57] ABSTRACT

An internal combustion engine has a carburetor and cylinders, each cylinder having two fuel/air intake ports, and also provided is a first manifold runner system having a fuel/air intake end communicating with one barrel of the carburetor, and a fuel/air delivery end communicating with one of the fuel/air intake ports at certain cylinders, and a second manifold runner system having a fuel/air intake end communicating with another barrel of the carburetor, and a fuel/air delivery end communicating with the other of the fuel/air intake ports at engine cylinders.

13 Claims, 7 Drawing Sheets

ENGINE AIR-FUEL INTAKE TRIPLE MANIFOLD

BACKGROUND OF THE INVENTION

This invention relates generally to internal combustion engine fuel/air intake manifolding, and more particularly, to improved manifolding and valving that enhance fuel/air supply to engine cylinders under different demand conditions.

Under increasing engine load conditions, there is need for enhanced fuel/air mixture supply to engine cylinders; this is normally facilitated by increasing the opening of the butterfly valve in the carburetor. It is known to have more than one air intake valve at each cylinder in order to pass more air/fuel mixture to the engines, particularly under high loads; however, more than one valve is not needed at lesser loads. There is need for a carburetor-manifold air-fuel intake valve system that is better balanced as respects fuel/air mixture flow to the cylinders under user's load requirements.

SUMMARY OF THE INVENTION

It is a major object of the invention to provide an improved fuel/air mixture intake manifold system that provides the better balance referred to. Basically, the invention is embodied in an internal combustion engine having a carburetor and cylinders, each cylinder having two air intake ports associated with air intake valves, the two valves at each cylinder opening and closing at substantially the same times. In this system, the invention provides:

(a) a first manifold runner system having a fuel/air intake end communicating with first barrel means of the carburetor, and a fuel/air delivery end or ends communicating with one of the fuel/air intake ports at each of certain engine cylinders, and (b) a second manifold runner system having a fuel/air intake end communicating with second barrel means of the carburetor, and a fuel/air delivery end or ends communicating with fuel/air intake ports at engine cylinders.

Typically, the carburetor has at least two barrels, including a first barrel communicating with the fuel/air intake end of the first manifold runner system, and a second barrel communicating with the fuel/air intake end of the second manifold runner system. The carburetor may have a third barrel communicating with one of the fuel/air intake ports at each of other engine cylinders.

Also, the carburetor has a mixture flow controlling butterfly in each barrel, and the butterflies may be controllably rotated so that at low engine loads, the fuel/air mixture is typically passed via two smaller barrels to two of the manifold runner systems for longer-path flow to one of the air ports at each cylinder; and at high engine loads the fuel/air mixture is passed via the additional and larger barrel to the other manifold runner system leading to the second air intake port at each cylinder. Accordingly, a better balanced, i.e., more "finely tuned", relationship is achieved as respects fuel/air mixture delivery or distribution to the cylinders, under different load conditions.

These and other objects and advantages of the invention, as well as the details of an illustrative embodiment, will be more fully understood from the following specification and drawings, in which:

DRAWING DESCRIPTION

DETAILED DESCRIPTION

Figure 1:
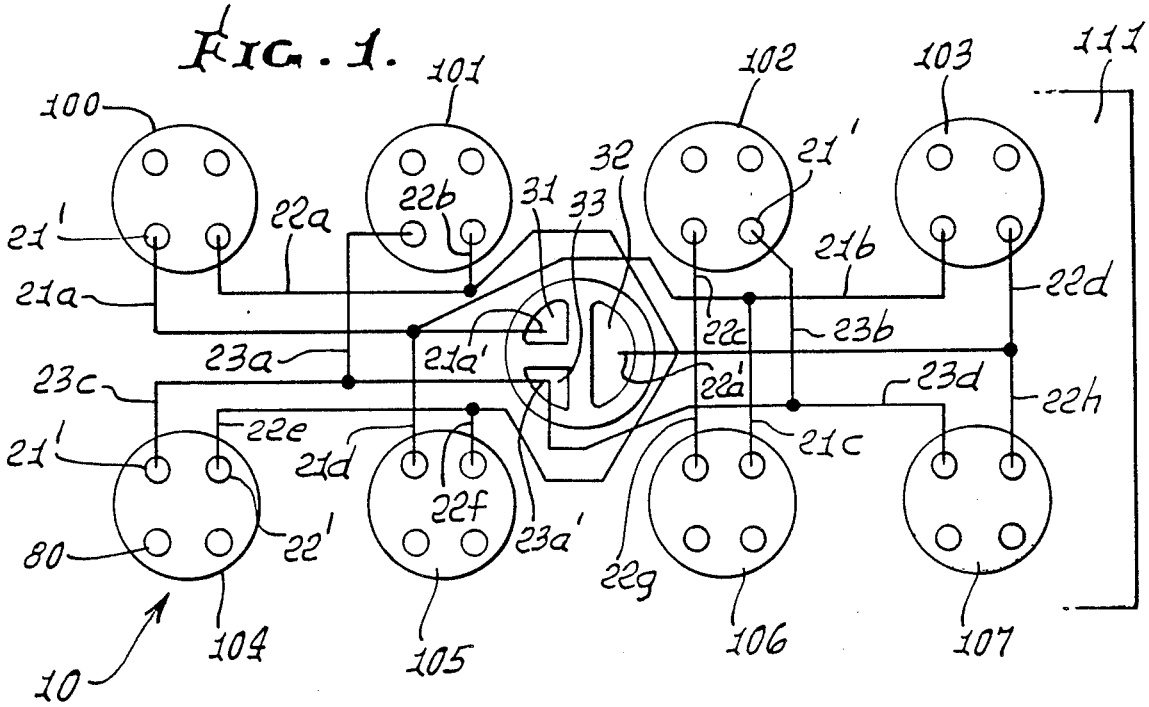
FIG. 1 is a schematic plan view of a system employing three fuel/air mixture manifold runner systems, a multi-barrel carburetor; and engine cylinders, each having two fuel/air mixture inlet valves and two exhaust valves.
Figure 2:
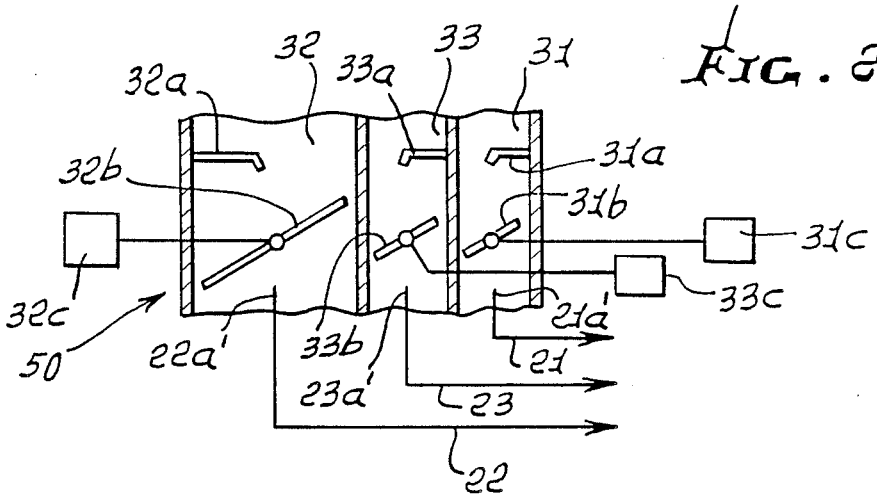
FIG. 2 is a schematic cross section in elevation of the carburetor seen in FIG. 1.
Figure 3:
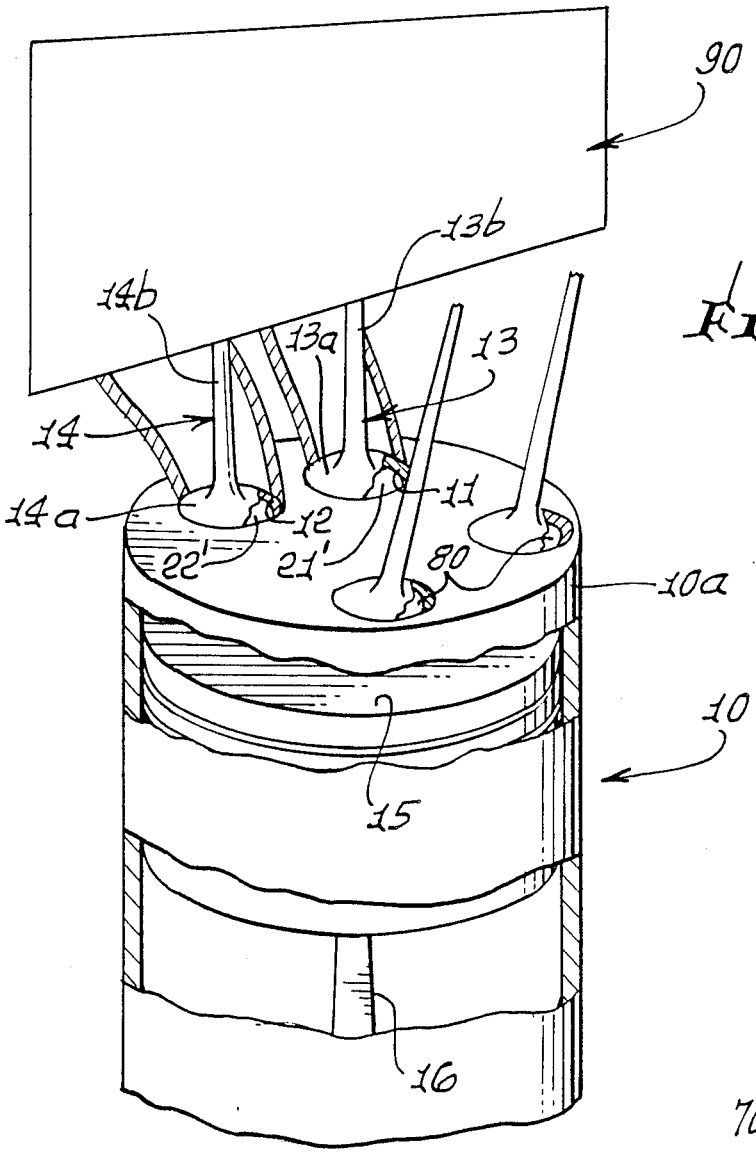
FIG. 3 is a schematic cross section taken in elevation, through an engine cylinder with two fuel/air mixture inlet valves and associated ports connected with two manifold runners, respectively.

Referring first to FIGS. 1–3, the engine cylinders 10 in an engine block 111 have cylinder heads 10*a* with dual fuel/air intake ports as at 21' and 22'. Ports associated with valve seats appear at 11 and 12. The engine may for example comprise a V-8 with two banks of cylinders. Valves 13 and 14 are associated with the respective ports to open and close them as by means of valve heads 13*a* and 14*a* that seat at the ports, as valve stems 13*b* and 14*b* are driven. Mechanism to drive the stems (push rods, rocker arms, and spring) is well known, and is generally indicated at 90. The timing is such that the intake ports at each cylinder are opened and closed in unison, or substantially in unison. Pistons and connecting rods are indicated at 15 and 16, and exhaust ports and valves for the cylinders appear schematically at 80, in FIG. 1.

First and second manifold runner systems are provided at 21 and 22 for transmitting fuel/air mixture from a carburetor 50 to the intake ports 21' and 22' in the cylinder heads. As shown, the first system 21 has an intake end or ends 21*a'* communicating with one portion of the carburetor, and a delivery end or ends communicating with one of the fuel/air intake ports at certain cylinders (as for example ports 21' at cylinders 100, 103, 105, and 106); and the second manifold runner system 22 has an intake end 22*a'* communicating with another portion of the carburetor, and a delivery end or ends communicating with the other of the fuel/air intake ports at each cylinder (as for example ports 22' at cylinders 100–107). In FIG. 1, the system 21 has four branches or runners 21*a*–21*d* leading to ports 21', and the system 22 likewise has eight branches or runners 22*a*–22*h* leading to all ports 22'. These are representative only.

In FIG. 2, the carburetor 50 has multiple barrels, as for example a first relatively small barrel 31 that delivers fuel/air mixture to system 21, and a second and relatively larger barrel 32 that delivers fuel/air mixture to system 22. A third barrel 33 (like 31) may be provided, and is shown as also delivering fuel/air mixture to a system 23. Manifold runner system 23 has four branches or runners 23*a*–23*d* leading to ports 21' at cylinders 101, 102, 104, and 107. Such runners are configured to be of substantially equal flow-path length, as will be seen, and as are runners 21a–21d, for optimum operational efficiency of the engine, and volumetric equalization of the cylinders. Barrel 33 may be the same size as barrel 31. Fuel supply jets appear at 31a, 32a, and 33a in the barrels, and fuel/air mixture flow control valves appear at 31b –33b. Means to control the rotation, i.e., the degree of opening of the butterfly valves are indicated at 31c–33c and they may be in turn controlled by operator depression of a foot pedal, or other device, manually or automatically.

Runners associated with system 22 include 22a to port 22' at cylinder 100; runner 22b to port 22' at cylinder 101; runner 22c to port 22' at cylinder 102; runner 22d to port 22' at cylinder 103; runner 22e to port 22' at cylinder 104; runner 22f to port and 22' at cylinder 105; runner 22g to port 22' at cylinder 106; and runner 22h to port 22' cylinder 107.

Figure 4:
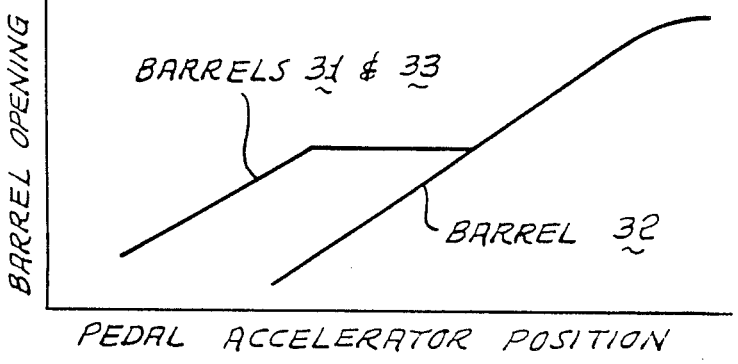
FIG. 4 is a diagram showing an example of relative openings of carburetor butterfly valves.

FIG. 4 shows an example of relative staggered openings of the butterfly valves as by foot pedal control and operation of means 31c–33c, to achieve increased flow of fuel/air mixture to the manifold runner systems as the butterfly valves are increasingly opened. Note that flow via the larger barrel 32 may commence when or just before flow through the first and third smaller barrels 31 and 33 has peaked, as may be required for high engine loads. Other relative butterfly openings may be used.

FIGS. 5–14 show integrated multiple manifold systems, with runners bearing the same numerals as in FIG. 1. Note that the runners of three systems 21–23 are efficiently intertwined and configured as to efficiently utilize the space available, and at the same time providing runners of substantially equal length leading to ports 11 and runner of substantially equal length leading to ports 12.

Figure 6:
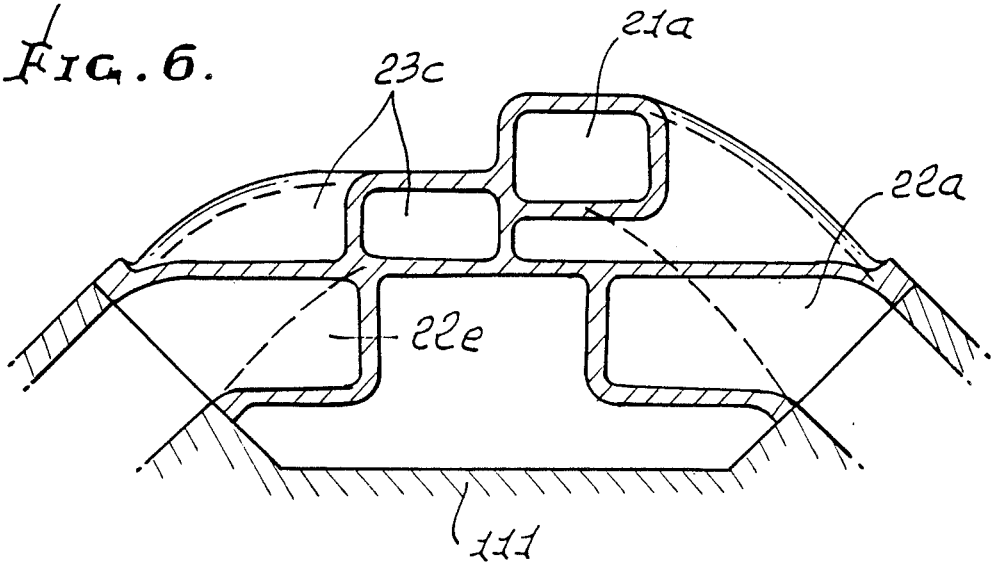
FIGS. 6–14 are sections taken on lines 6—6, 7—7, 8—8, 9—9, 10—10, 11—11, 12—12, 13—13, and 14—14 seen in FIG. 5.
Figure 7:
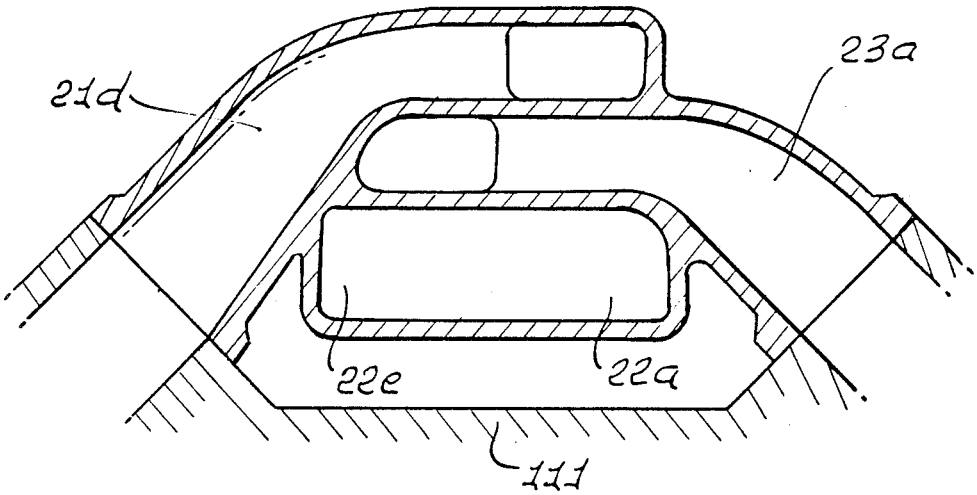
Figure 8:
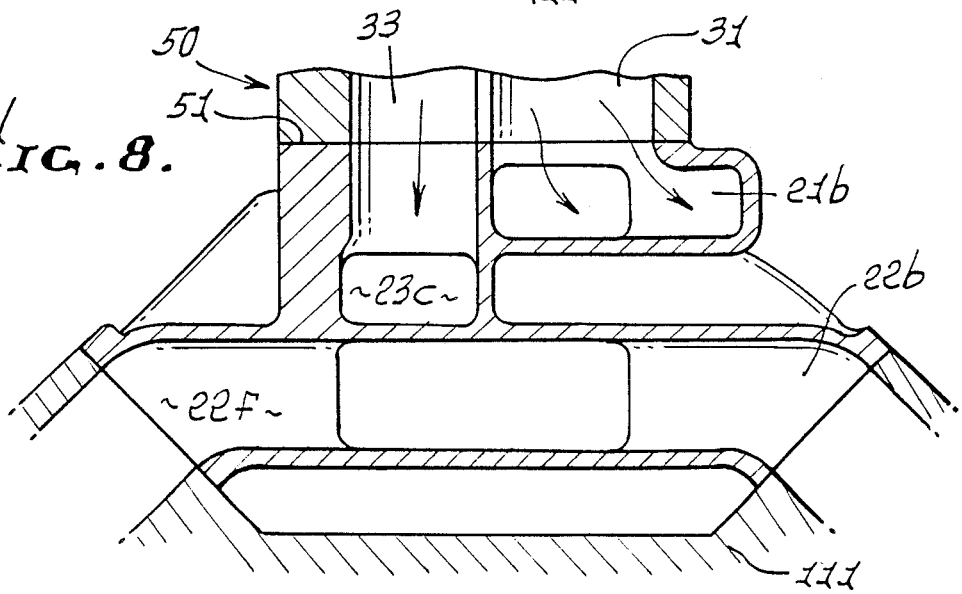

In FIG. 6, runners 22a and 22e pass beneath runners 21a and 23c; in FIG. 7, runners 22a and 22e are merged, beneath runners 23a and 21d; and in FIG. 8, runners 22b and 22f extend beneath runners 23c and 21b, as shown. Also in FIG. 8, the carburetor 50 is seated or attached to the assembly at 51, i.e. typically centrally; and carburetor barrel 31 feeds runners 21a, 21b, 21c, and 21d; while carburetor barrel 33 feeds runners 23a, 23b, 23c, and 23d.

Figure 9:
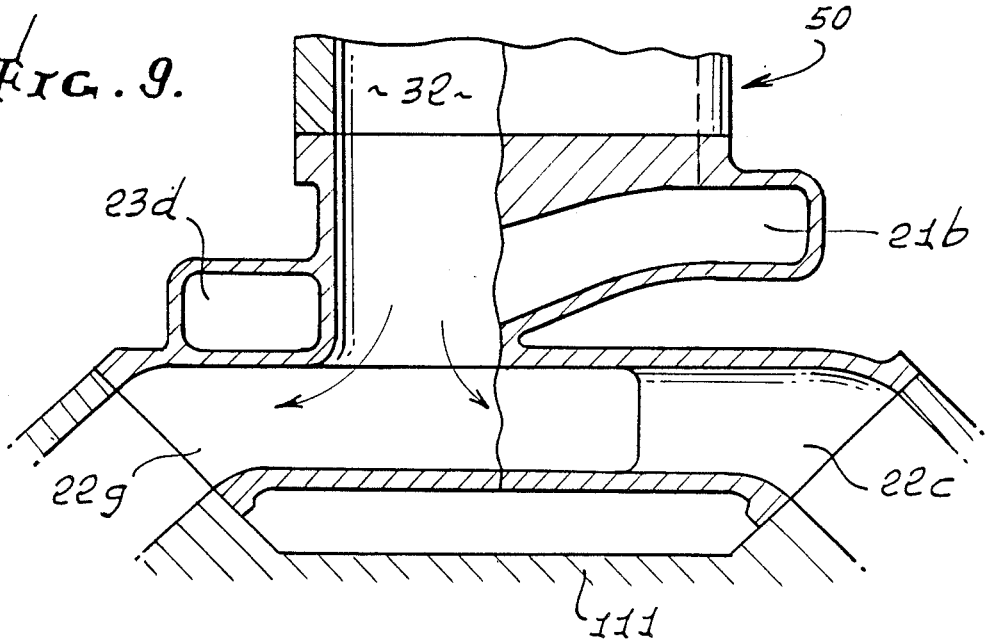
Figure 10:
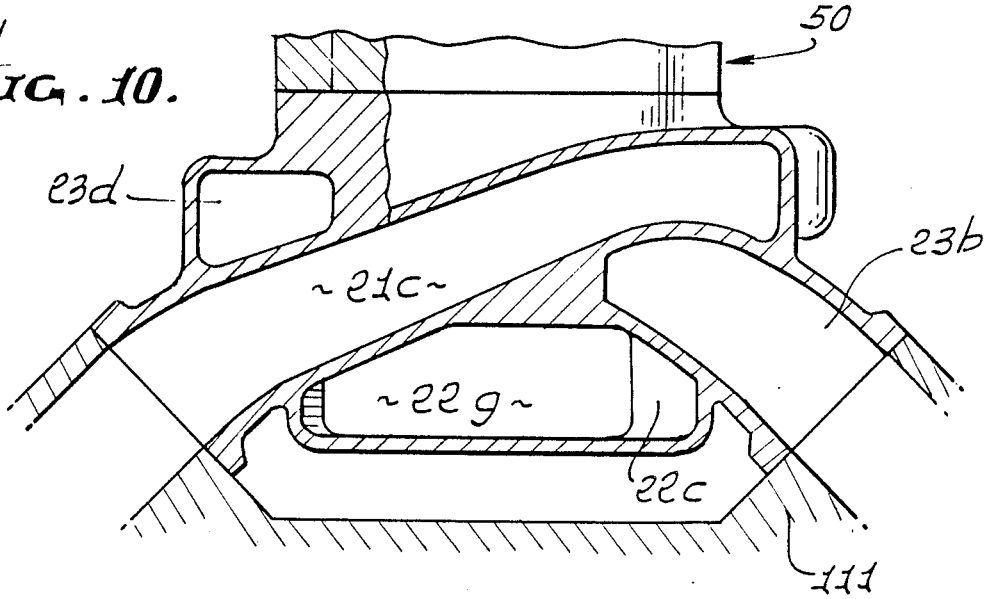
Figure 11:
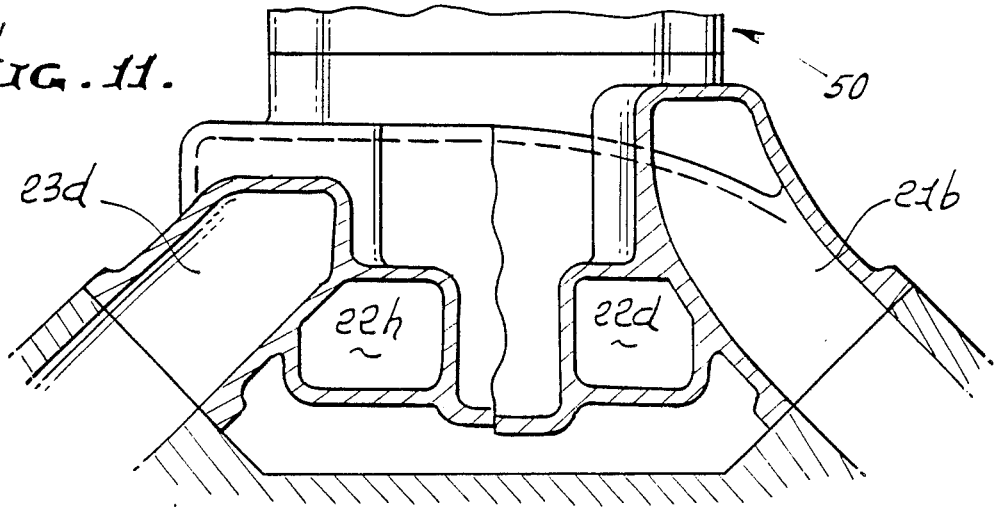

In FIG. 9, the carburetor barrel 32 feeds the fuel/air mixture to lateral runners 22c and 22g, beneath longitudinally extending runner 23d and longitudinally extending runner 21b. In FIG. 10, runners 22c and 22g are merged beneath runners 21c and 23b, and runner 21c dips beneath part of 23b. In FIG. 11, the runners 22d and 22h extend generally beneath runners 21b and 23d, respectively.

Figure 12:
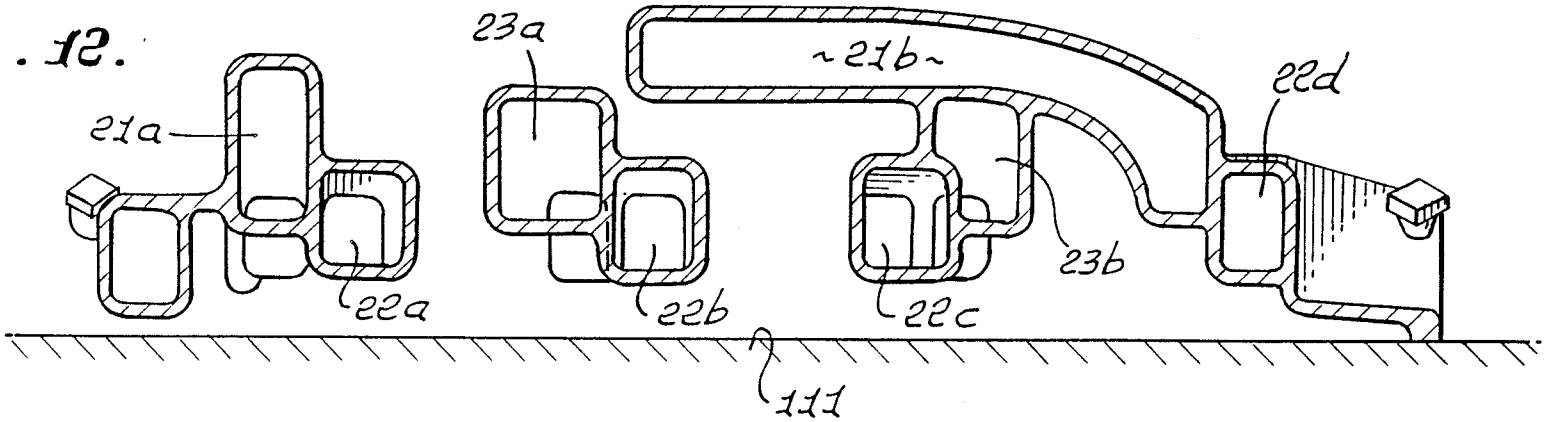
Figure 13:
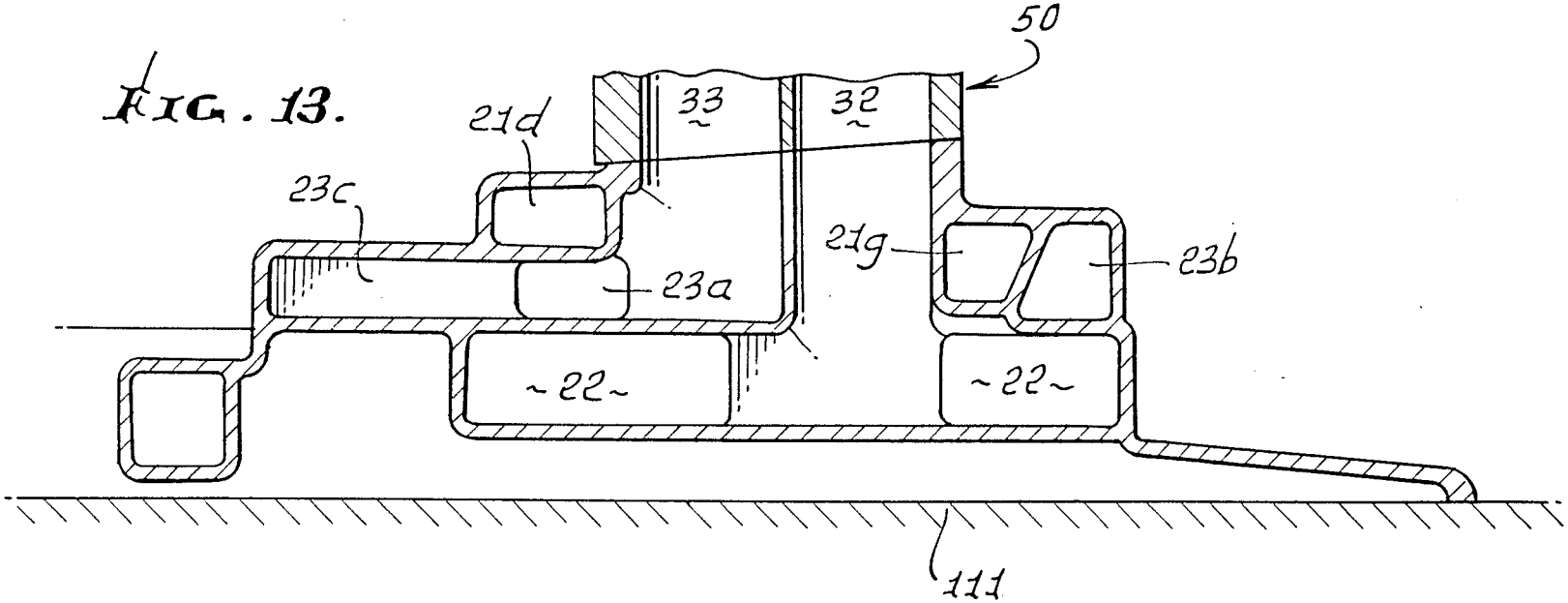
Figure 14:
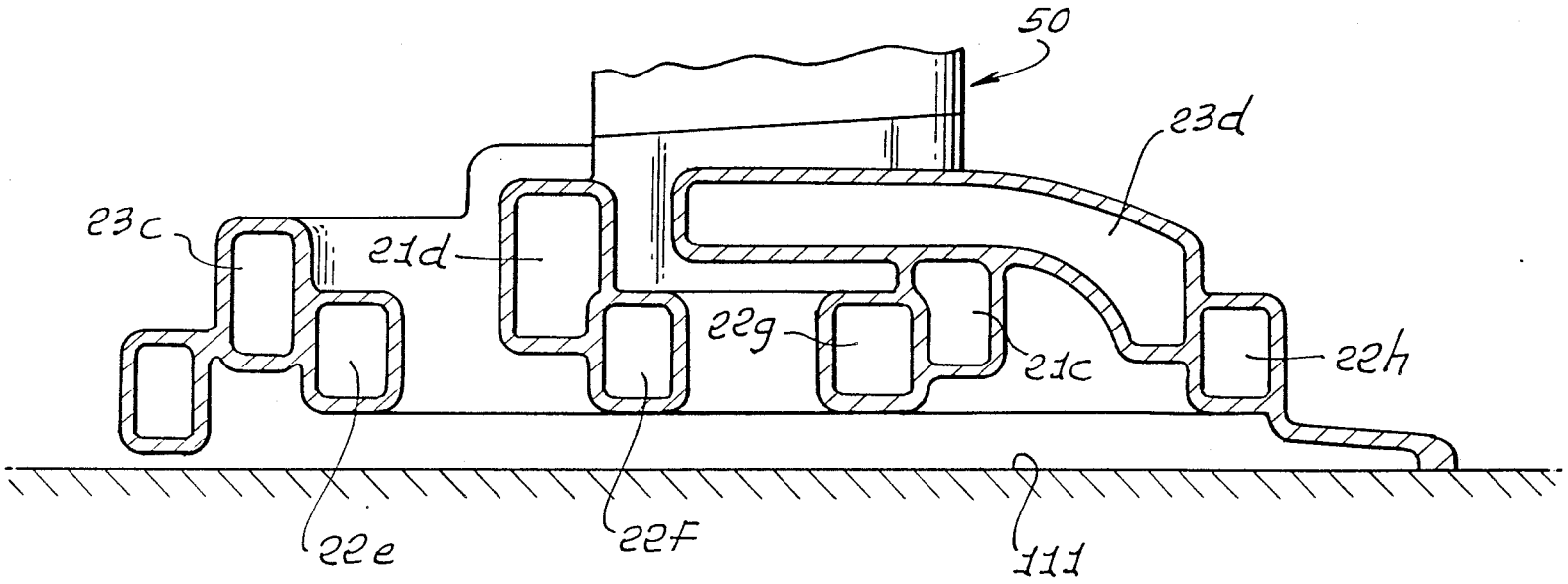

FIGS. 12–14 are longitudinal vertical sections through the assembly, as indicated.

Figure 15:
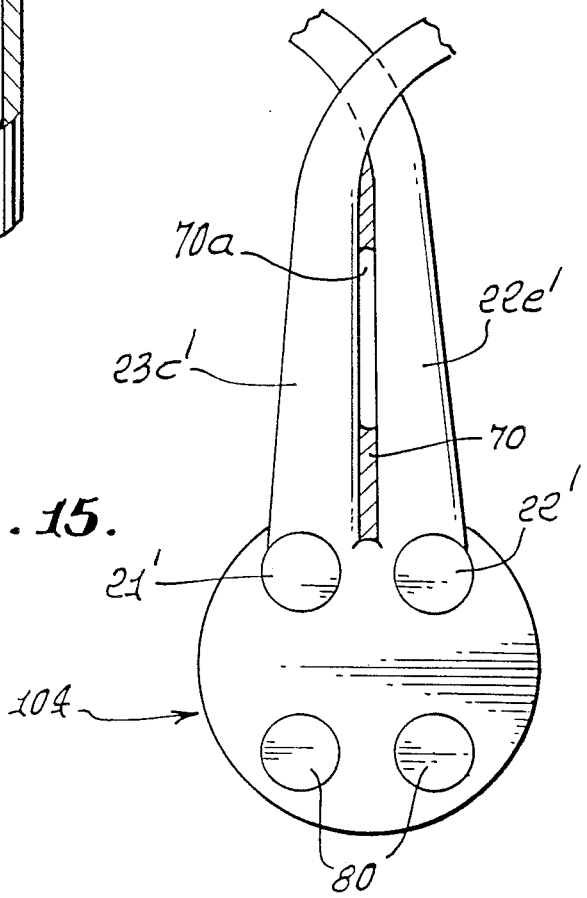
FIG. 15 shows a modified arrangement of adjacent runners, allowing by-passing of mixture from one to the other.
Figure 5:
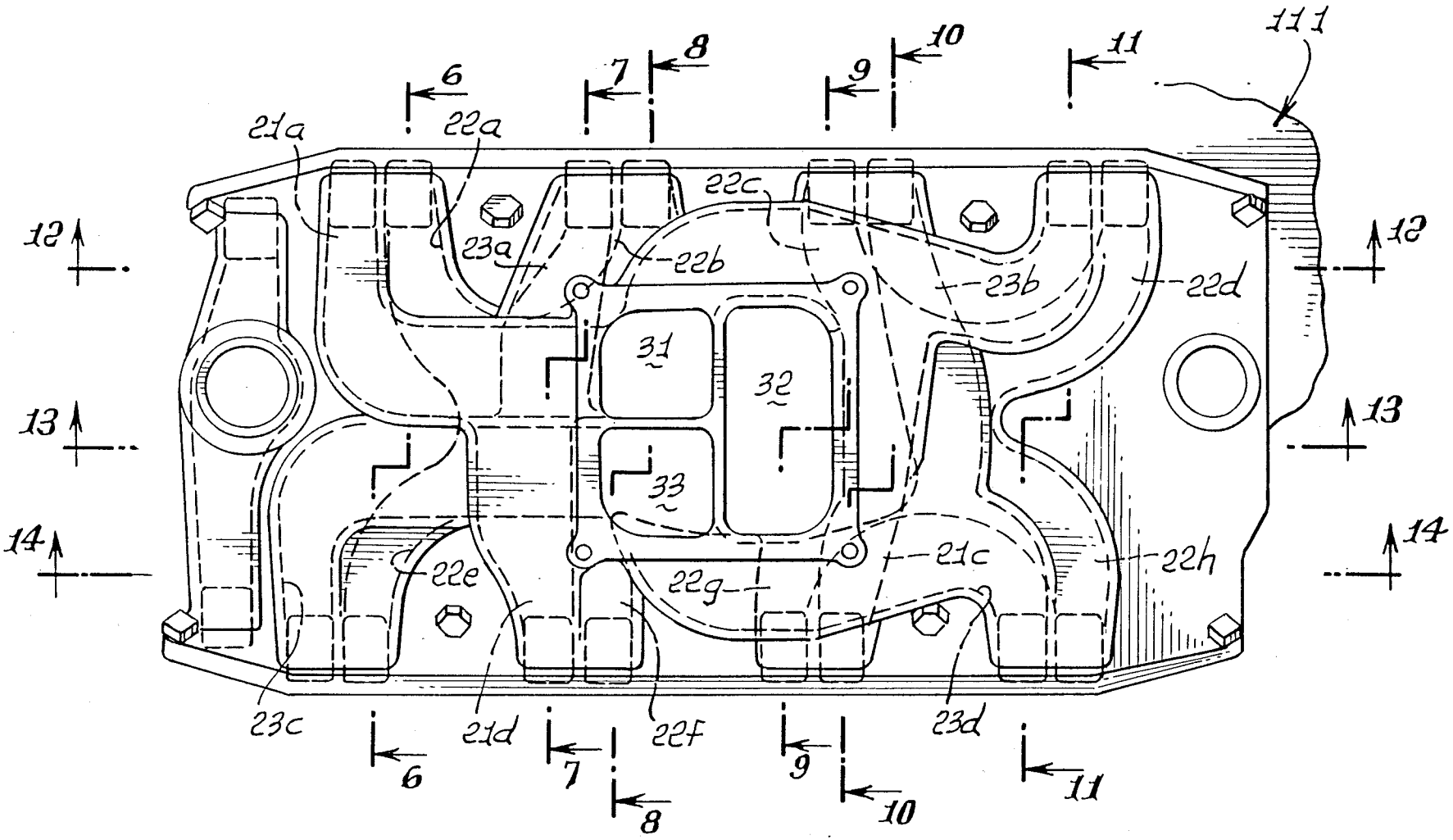
FIG. 5 is a top plan view of an actual multiple, layered manifold runner arrangement.

FIG. 15 is a view showing two adjacent modified runners, as for example at 22e' and 23c' leading to cylinder 104, and they correspond to runners 22e and 23c. They have a common intermediate laterally extending wall at 70, just prior to the ports 21' and 22'. That wall may have a through opening at 70a, so that some fuel/air mixture in one runner can flow into the other runner, as at times when the latter is not fed with mixture from its corresponding runner. Thus, when barrel 32 is closed by its butterfly, and barrel 33 is partly open, some of the fuel/air mixture in runner 23c' can flow into runner 22e', and enter the cylinder via port 22', for greater mixture efficiency. In this regard, both inlet valves at each cylinder open and close in unison, or substantially in unison. Each cylinder may have one or two exhaust valves, as at 80.

I claim:

1. In an internal combustion engine having cylinders and a carburetor defining barrel means, each cylinder having two fuel/air intake ports, the combination comprising (a) a first manifold runner system having a fuel/air intake end communicating with first barrel means of the carburetor, and a fuel/air delivery end or ends communicating with one of the fuel/air intake ports at each of certain engine cylinders, and (b) a second manifold runner system having a fuel/air intake end communicating with second barrel means of the carburetor, and a fuel/air delivery end or ends communicating with fuel/air intake ports at each cylinder, (c) the first manifold runner system serving less than all of the engine cylinders, and the second manifold runner system serving all of the engine cylinders.

2. The combination of claim 1 wherein the second manifold runner system defines substantially equal length fuel/air paths between said second manifold runner system intake end and said delivery ends.

3. The combination of claim 2 including a first butterfly in the first barrel means, and a second butterfly in the second barrel means, and actuator means connected with the butterflies to successively rotate the butterflies toward open position.

4. The combination of claim 1 wherein the first manifold runner system defines substantially equal length fuel/air paths between said first manifold runner systems intake end and said delivery ends.

5. In an internal combustion engine having cylinders and a carburetor defining barrel means, each cylinder having two fuel/air intake ports, the combination comprising (a) a first manifold runner system having a fuel/air intake end communicating with first barrel means of the carburetor, and a fuel/air delivery end or ends communicating with one of the fuel/air intake ports at each of certain engine cylinders, said first manifold runner system serving less than all of the engine cylinders and (b) a second manifold runner system having a fuel/air intake end communicating with second barrel means of the carburetor, and a fuel/air delivery end or ends communicating with fuel/air intake ports at each cylinder, (c) and including first and second air intake valves at the first and second fuel/air intake ports, and means to controllably open said first and second valves.

6. The combination of claim 3 including a control operatively connected to said means to successively rotate the butterflies thereby to place the manifold runner systems successively into operation to pass air to the cylinders.

7. In an internal combustion engine having cylinders and a carburetor defining barrel means, each cylinder having two fuel/air intake ports, the combination comprising (a) a first manifold runner system having a fuel/air intake end communicating with first barrel means of the carburetor, and a fuel/air delivery end or ends communicating with one of the fuel/air intake ports at each of certain engine cylinders, and (b) a second manifold runner system having a fuel/air intake end communicating with second barrel means of the carburetor, and a fuel/air delivery end or ends communicating with fuel/air intake ports at each cylinder, (c) a first butterfly in the first barrel means, and a second butterfly in the second barrel means, and actuator means connected with the butterflies to successively rotate the butterflies toward open position, (d) and including a third manifold runner system having a fuel/air intake end communicating with third barrel means of the carburetor, and a fuel/air delivery end or ends communicating with one of the fuel/air intake ports at each of other engine cylinders.

8. The combination of claim 7 including a third butterfly in said third barrel, said actuator means also connected with the third butterfly to rotate it toward open position in conjunction with said rotation of the first butterfly.

9. The combination of claim 1 wherein the manifold runner systems are at least partly superimposed, and extend generally horizontally in opposite lateral and longitudinal directions from the carburetor.

10. The combination of claim 7 wherein the manifold runner systems are at least partly superimposed, and extend generally horizontally in opposite lateral and longitudinal directions from the carburetor and, wherein the first and third barrels are longitudinally spaced from the second barrel.

11. The combination of claim 9 wherein the manifold runner systems have runners leading to the fuel/air inlet ports, the runner of each manifold runner system having approximately equal length.

12. In an internal combustion engine having cylinders and a carburetor defining barrel means, each cylinder having two fuel/air intake ports, the combination comprising (a) a first manifold runner system having a fuel/air intake end communicating with first barrel means of the carburetor, and a fuel/air delivery end or ends communicating with one of the fuel/air intake ports at each of certain engine cylinders, and (b) a second manifold runner system having a fuel/air intake end communicating with second barrel means of the carburetor, and a fuel/air delivery end or ends communicating with fuel/air intake ports at each cylinder, (c) the manifold runner systems being at least partly superimposed, and extending generally horizontally in opposite lateral and longitudinal directions from the carburetor, (d) the manifold runner systems having runners leading to the fuel/air inlet ports, the runners of each manifold runner system having approximately equal length, (d) and wherein there are eight cylinders arranged in two parallel longitudinal banks of four cylinders each, the carburetor located above the banks, and approximately mid way between opposite ends of the banks, the first manifold runner system feeding four of the cylinders, and the third manifold runner system feeding a different four of the cylinders.

13. The combination of claim 11 wherein two runners extending to a cylinder inlet port have intercommunication via an opening therebetween.

* * * * *